US009605525B2

(12) United States Patent
Kajaria et al.

(10) Patent No.: US 9,605,525 B2
(45) Date of Patent: Mar. 28, 2017

(54) LINE MANIFOLD FOR CONCURRENT FRACTURE OPERATIONS

(71) Applicants: Saurabh Kajaria, Houston, TX (US); Tom Maloney, League City, TX (US); Case Nienhuis, Conroe, TX (US)

(72) Inventors: Saurabh Kajaria, Houston, TX (US); Tom Maloney, League City, TX (US); Case Nienhuis, Conroe, TX (US)

(73) Assignee: GE OIL & GAS PRESSURE CONTROL LP, Houston, TX (US)

( * ) Notice: Subject to any disclaimer, the term of this patent is extended or adjusted under 35 U.S.C. 154(b) by 412 days.

(21) Appl. No.: 14/142,451

(22) Filed: Dec. 27, 2013

(65) Prior Publication Data

US 2015/0184491 A1 Jul. 2, 2015
US 2017/0044872 A9 Feb. 16, 2017

Related U.S. Application Data

(60) Provisional application No. 61/805,296, filed on Mar. 26, 2013.

(51) Int. Cl.
*E21B 41/00* (2006.01)
*E21B 43/26* (2006.01)
*E21B 34/02* (2006.01)

(52) U.S. Cl.
CPC ..... *E21B 43/26* (2013.01); *E21B 34/02* (2013.01); *Y10T 29/49826* (2015.01)

(58) Field of Classification Search
CPC ..... E21B 43/26; E21B 33/03; E21B 34/02; E21B 34/14; E21B 17/02
See application file for complete search history.

(56) References Cited

U.S. PATENT DOCUMENTS 3,894,493 A 7/1975 Strecker
4,218,080 A 8/1980 Kendrick
4,420,916 A 12/1983 Ricketts
4,448,535 A 5/1984 West
4,603,887 A * 8/1986 Mayfield ..... E21B 21/02 285/298

(Continued)

FOREIGN PATENT DOCUMENTS

EP 0251991 A1 1/1988
WO 0140691 A1 6/2001

OTHER PUBLICATIONS

Invitation to Pay Additional Fees issued in connection with corresponding PCT/US2014/031548 on Jul. 30, 2014.

(Continued)

*Primary Examiner* — Daniel P Stephenson
(74) *Attorney, Agent, or Firm* — Hogan Lovells US LLP

(57) ABSTRACT

A modular, adjustable system for distributing fluids to one or more wellbores includes a plurality of modules that can be arranged at a well site to create an appropriate manifold to enable selective fluid communication between a fluid pumping system and the one or more wellbores. The modules each include a fluid inlet, a fluid outlet and a valve coupled therebetween to selectively permit or restrict fluid flow between the respective fluid inlets and fluid outlets. The modules are configured to be readily maneuvered, coupled and locked to one another at a well site.

16 Claims, 9 Drawing Sheets

(56) References Cited

U.S. PATENT DOCUMENTS

| | | | | |
|---|---|---|---|---|
| 4,767,136 | A * | 8/1988 | Lehmann | F16L 37/26 285/32 |
| 4,911,318 | A | 3/1990 | Bishop | |
| 4,950,114 | A | 8/1990 | Borchardt | |
| 5,089,131 | A | 2/1992 | Gentry | |
| 6,267,191 | B1 | 7/2001 | Hettinger | |
| 6,306,800 | B1 | 10/2001 | Samuel et al. | |
| 6,435,277 | B1 | 8/2002 | Qu et al. | |
| 6,698,915 | B2 | 3/2004 | Dearing et al. | |
| 7,073,592 | B2 | 7/2006 | Polsky et al. | |
| 7,478,673 | B2 | 1/2009 | Boyd | |
| 7,841,394 | B2 | 11/2010 | McNeel et al. | |
| 7,921,914 | B2 | 4/2011 | Bruins et al. | |
| 8,146,665 | B2 | 4/2012 | Neal | |
| 8,261,841 | B2 | 9/2012 | Bailey et al. | |
| 8,978,763 | B2 * | 3/2015 | Guidry | E21B 43/26 166/177.5 |
| 9,127,545 | B2 * | 9/2015 | Kajaria | E21B 43/26 |
| 9,222,345 | B2 * | 12/2015 | Conrad | E21B 43/26 |
| 2008/0029267 | A1 | 2/2008 | Shampine et al. | |
| 2008/0083530 | A1 | 4/2008 | Boyd | |
| 2009/0261575 | A1 * | 10/2009 | Bull | E21B 17/02 285/32 |
| 2010/0300672 | A1 | 12/2010 | Childress et al. | |
| 2011/0030963 | A1 | 2/2011 | Demong et al. | |
| 2011/0048695 | A1 | 3/2011 | Cherewyk et al. | |
| 2011/0259584 | A1 | 10/2011 | Broussard, II | |
| 2011/0272158 | A1 | 11/2011 | Neal | |
| 2012/0085541 | A1 | 4/2012 | Love et al. | |
| 2012/0181013 | A1 | 7/2012 | Kajaria et al. | |
| 2012/0181015 | A1 | 7/2012 | Kajaria et al. | |
| 2012/0181016 | A1 | 7/2012 | Kajaria et al. | |
| 2012/0181030 | A1 | 7/2012 | Kajaria et al. | |
| 2012/0181046 | A1 | 7/2012 | Kajaria et al. | |
| 2012/0255734 | A1 | 10/2012 | Coli et al. | |
| 2013/0175038 | A1 | 7/2013 | Conrad | |
| 2013/0175039 | A1 | 7/2013 | Guidry | |
| 2013/0284455 | A1 | 10/2013 | Kajaria et al. | |
| 2014/0096974 | A1 * | 4/2014 | Coli | E21B 43/26 166/358 |
| 2015/0000766 | A1 * | 1/2015 | Arizpe | F16L 41/03 137/356 |
| 2015/0184491 | A1 * | 7/2015 | Kajaria | E21B 43/26 166/90.1 |
| 2015/0292297 | A1 * | 10/2015 | Kajaria | E21B 34/02 166/250.01 |

OTHER PUBLICATIONS

Weir, "Pressure Control Systems Seaboard (TM) Products Excellent Oil & Gas Solutions for more product information", 2013.

Supreme Services & Specialty Co Inc, "Supreme Services Product Catalogue 2012."

Supreme Services & Specialty Co Inc,"Supreme Services—Featured Products", 2011.

Weir, "Seaboard Frac Flowback Services: expertise when the pressure is on", Weir bulletin Jul. 2013.

International Search Report and Written Opinion issued in connection with corresponding PCT Application No. PCT/US2014/031548 dated Feb. 17, 2015.

API 6A Mud Valves (Complete Solutions for Industrial Valves)—Neway Valve, Cat. No. E-MV-2004, pp. 1-4.

* cited by examiner

LINE MANIFOLD FOR CONCURRENT FRACTURE OPERATIONS

RELATED APPLICATION

This application is a non-provisional of and claims the benefit of and priority to U.S. Provisional Patent Application No. 61/805,296 titled "Line Manifold for Concurrent Fracture Operations" filed Mar. 26, 2013, which is incorporated herein by reference in its entirety.

BACKGROUND OF THE INVENTION

1. Field of the Invention

The present invention relates in general to oilfield applications involving the fluid treatment of wellbores. More specifically, the invention relates to systems for controlling the distribution of fluid to one or more wellbores.

2. Description of the Related Art

Hydraulic fracturing is one type of fluid treatment for a wellbore in which a fluid is pumped into a subterranean geologic formation through the wellbore. The fluid is provided at a sufficient pressure to fracture the geologic formation, thus facilitating the recovery of hydrocarbons from the formation. Often, the wellbore is subjected to multiple fluid treatment cycles in which fluid is provided and subsequently extracted. Between treatment cycles, down-hole operations may be carried out in the wellbore to install equipment or to evaluate the effectiveness of the most recent treatment cycle.

Generally between treatment cycles, pumping equipment is disconnected from the wellbore and connected to a second wellbore such that the fluid treatment may be carried out on the second wellbore concurrently with other down-hole operations on the first wellbore. Because these connections and disconnections consume a considerable amount of time and manpower, some manifolds have been developed that enable selective pumping to one or more wellbores. These manifolds are typically designed and constructed remotely for use in a particular application to accommodate a particular number of wellbores. These manifolds are less effective when used for subsequent operations at a well site with a different number of wellbores. Also, these manifolds are not configurable at the well site to accommodate changing conditions and needs. For example, when a sufficient number of treatment cycles have been performed on some of the wellbores coupled to the manifold, and additional treatment cycles are intended for other wellbores coupled to the manifold, only a portion of the manifold is used. This results in significant costs for an operator who must keep an inventory sufficient to accommodate unused portions of manifolds.

SUMMARY OF THE INVENTION

Described herein is a modular, adjustable system for distributing fluids to one or more wellbores. The system includes a plurality of modules that are configured to enable selective fluid communication between a fluid pumping system and an individual wellbore. The modules can be combined in any number to create an appropriate fluid distribution system for the well site having any number of wellbores. The modules are configured to be readily coupled and locked together at the well site, and may be transported together in a locked configuration to a different location at the well site.

According to a one example embodiment of the invention, a fluid distribution system for use in a fluid system for providing fluid treatments to a plurality of wellbores includes a first module, a second module, and a locking mechanism operable to selectively lock the first module to the second module to prevent relative motion therebetween. The first module includes a first skid for providing foundational support to the first module, a first fluid inlet mounted to the first skid and that is operable to selectively fluidly couple to a fluid source for receiving a fluid therefrom, a first fluid outlet mounted to the first skid and that is operable to selectively fluidly couple to a first wellhead to deliver the fluid thereto, and at least one first valve coupled between the first fluid inlet and the first fluid outlet that is operable to selectively permit or restrict fluid flow between the first fluid inlet and the first fluid outlet. The second module includes a second skid for providing foundational support to the second module, a second fluid inlet mounted to the second skid and fluidly coupled to the first module between the first fluid inlet and the at least one first valve for receiving the fluid from the first module, a second fluid outlet mounted to the second skid and that is operable to selectively couple to a second wellhead to deliver the fluid thereto, and at least one second valve coupled between the second fluid inlet and the second fluid outlet that is operable to selectively permit or restrict fluid flow between the second fluid inlet and the second fluid outlet.

According to another embodiment of the invention, a fluid distribution system for use in a fluid system for providing fluid treatments to a plurality of wellbores includes a first module having a first fluid inlet, a first fluid outlet and at least one first valve coupled between the first fluid inlet and the first fluid outlet. The first fluid inlet, first fluid outlet and the at least one first valve are arranged along a generally straight first axis. The fluid distribution system also includes a second module having a second fluid inlet, a second fluid outlet and at least one second valve coupled between the second inlet and the second outlet. The second fluid inlet, the second fluid outlet and the at least one second valve are arranged along a generally straight second axis. A first fluid conduit extends between the first module and the second module along a third axis that is generally orthogonal to the first axis and the second axis. The first fluid conduit fluidly couples the second fluid inlet to the first fluid module between the first fluid inlet and the at least one first valve.

According to another embodiment of the invention, a method for assembling fluid distribution system for providing fluid treatments to a plurality of wellbores includes the steps of (a) providing a first module including a first fluid inlet, a first fluid outlet and a first valve mounted to a first skid, the first valve coupled between the first fluid inlet and the first fluid outlet, (b) providing a second module including a second fluid inlet, a second fluid outlet, and a second valve mounted to a second skid, the second valve coupled between the second fluid inlet and the second fluid outlet, (c) approximating the first skid and the second skid, (d) locking the first skid to the second skid to prevent relative motion therebetween, and (e) coupling a fluid conduit between the second fluid inlet and the first module between the first fluid inlet and the first valve.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
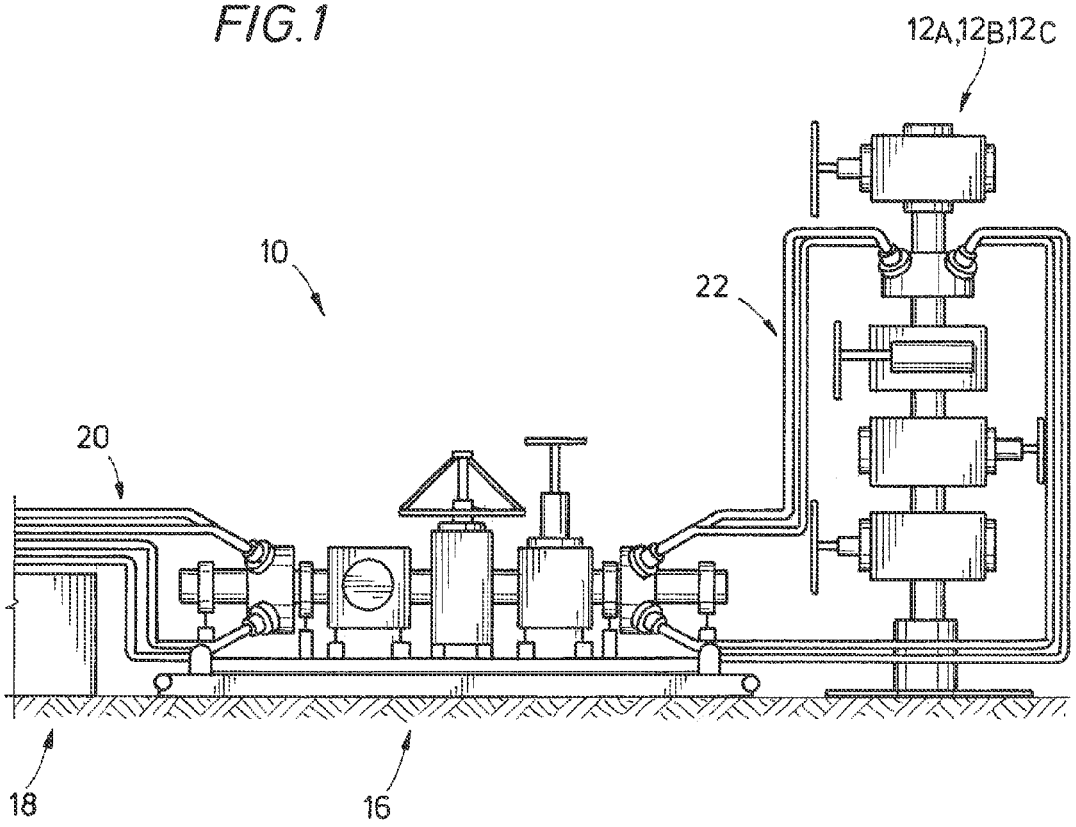
FIG. 1 is a side view of a fluid distribution system in accordance with one embodiment of the present invention including three modules installed at a well site between a fluid pumping system and a plurality of wellbores.
Figure 2:
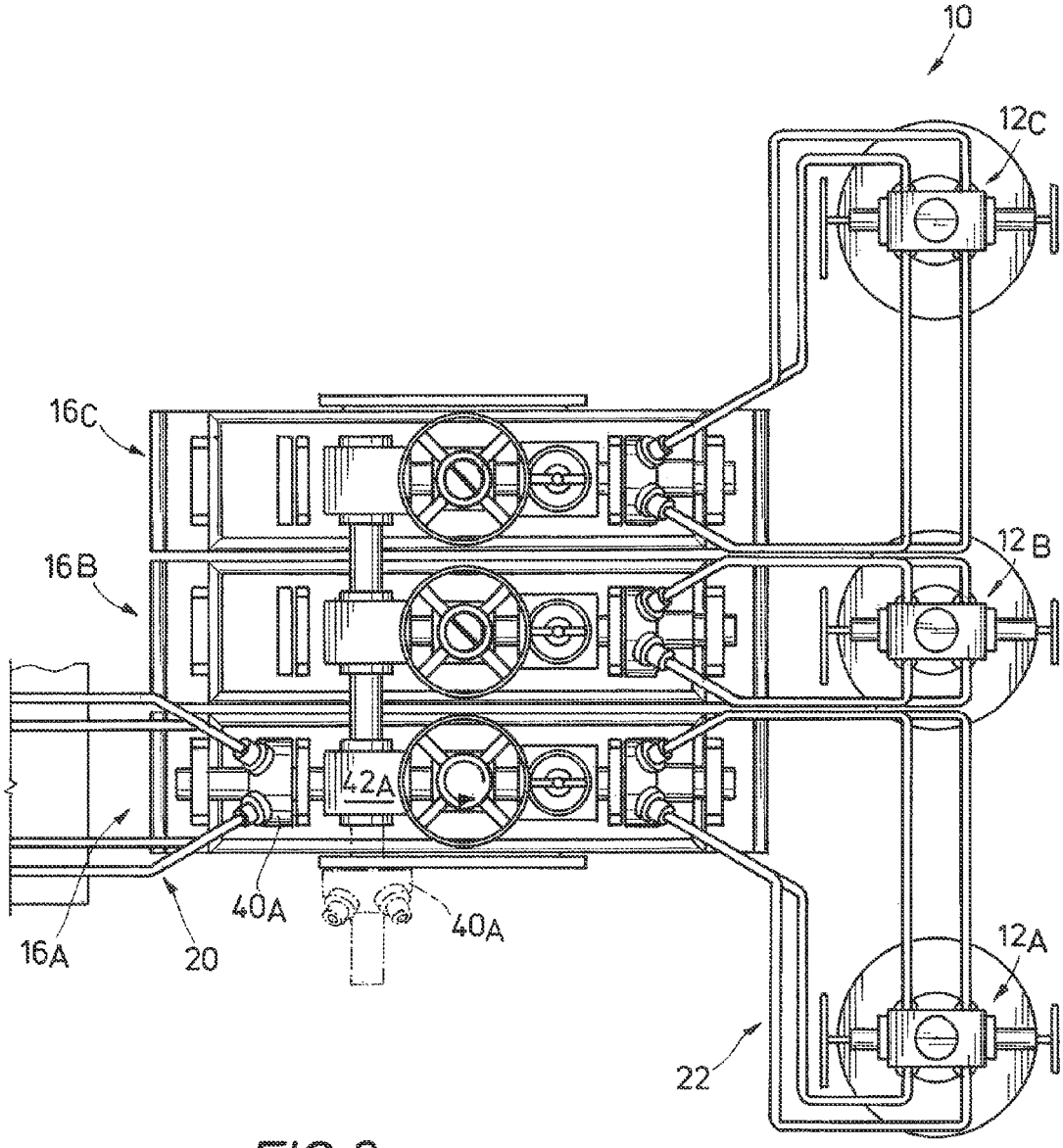
FIG. 2 is an overhead view of the fluid distribution system of FIG. 1 schematically illustrating the selective distribution of fluid to one wellbore of the plurality of wellbores.

Referring generally to FIGS. 1 and 2, an example embodiment of a fluid treatment system 10 is configured to provide fluid treatments to a plurality of wellbores (not shown) associated with a plurality of wellheads $\mathbf{12}_A$, $\mathbf{12}_B$, and $\mathbf{12}_C$. Each of the wellbores is in fluid communication with a respective one of wellheads $\mathbf{12}_A$, $\mathbf{12}_B$, and $\mathbf{12}_C$, and fluidly isolated from the other wellbores. The wellheads $\mathbf{12}_A$, $\mathbf{12}_B$, and $\mathbf{12}_C$ are fluidly coupled to a modular fluid distribution system 16, which is fluidly coupled to a fluid source such as pump truck 18. The pump truck 18 provides a pressurized fluid, such as a frac fluid containing water, sand and chemical additives, to the modular fluid distribution system 16, which is operable to control the distribution of the fluid to the wellheads $\mathbf{12}_A$, $\mathbf{12}_B$, and $\mathbf{12}_C$. The modular fluid distribution system 16 includes first, second, and third modules $\mathbf{16}_A$, $\mathbf{16}_B$, and $\mathbf{16}_C$ coupled and locked to one another as described in greater detail below. First module $\mathbf{16}_A$ includes an inlet goat-head $\mathbf{40}_A$ (described in greater detail with reference to FIG. 3), which detachably couples to fluid supply lines 20 to receive fluid from the pump truck 18. An alternate location for inlet goat-head $\mathbf{40}_A$ is depicted in phantom, and in some embodiments, the inlet goat-head $\mathbf{40}_A$ is eliminated and the fluid supply lines couple directly to a 4-way cross $\mathbf{42}_A$. Second and third modules $\mathbf{16}_B$ and $\mathbf{16}_C$ are in fluid communication with the first module $\mathbf{16}_A$ such that each of the modules receives the fluid from the pump truck 18. Each of the modules $\mathbf{16}_A$, $\mathbf{16}_B$ and $\mathbf{16}_C$ is configured to detachably couple to fluid distribution lines 22 such that each of the modules $\mathbf{16}_A$, $\mathbf{16}_B$ and $\mathbf{16}_C$ is in fluid communication with a respective one of the wellheads $\mathbf{12}_A$, $\mathbf{12}_B$ and $\mathbf{12}_C$. In particular, fluid lines 22 extend between first module $\mathbf{16}_A$ and wellhead $\mathbf{12}_A$, between second module $\mathbf{16}_B$ and wellhead $\mathbf{12}_B$, and between the third module $\mathbf{16}_C$ and wellhead $\mathbf{16}_C$.

Each of the modules $\mathbf{16}_A$, $\mathbf{16}_B$ and $\mathbf{16}_C$ is configured to selectively permit or restrict fluid flow therethrough to thereby selectively permit or restrict fluid flow to the respective wellhead $\mathbf{12}_A$, $\mathbf{12}_B$ and $\mathbf{12}_C$. Thus, in an example embodiment of use, the first module $\mathbf{16}_A$ may be arranged to permit fluid flow therethrough while the second and third modules $\mathbf{16}_B$, $\mathbf{16}_C$ are arranged to restrict fluid flow therethrough as schematically indicated in FIG. 2. Fluid is provided to the wellhead $\mathbf{12}_A$ from the pump truck 18 through the first module $\mathbf{16}_A$, and the wellheads $\mathbf{12}_B$, $\mathbf{12}_C$ are fluidly isolated from the pump truck 18 by the second and third modules $\mathbf{16}_B$ and $\mathbf{16}_C$. The wellbore associated with wellhead $\mathbf{12}_A$ undergoes a cycle of a fluid treatment while the wellbores associated with wellheads $\mathbf{12}_B$ and $\mathbf{12}_C$ are available for down-hole operations. When the treatment cycle is complete, the fluid distribution system 16 is rearranged to restrict fluid flow through the first and third modules $\mathbf{16}_A$ and $\mathbf{16}_C$ while permitting fluid flow through the second module $\mathbf{16}_B$. In this way, the wellbore associated with wellhead $\mathbf{12}_B$ undergoes a cycle of fluid treatment while the wellbores associated with wellheads $\mathbf{12}_A$ and $\mathbf{12}_C$ are available for down-hole operations. In this example embodiment of use, the fluid distribution system 16 is rearranged in this manner until each of the wellbores undergoes a plurality of cycles of the fluid treatment. In some embodiments, wellbores undergo about twenty (20) cycles of the fluid treatment.

The type of procedure described above is often referred to as "concurrent" operations since the fluid treatment cycles in one wellbore takes place concurrently with other down-hole operations in another wellbore. These other operations may include installing equipment or evaluating the effectiveness of a previous fluid treatment. In other embodiments of use, the fluid distribution system 16 may be arranged to provide fluid simultaneously to more than one wellbore.

Figure 3:
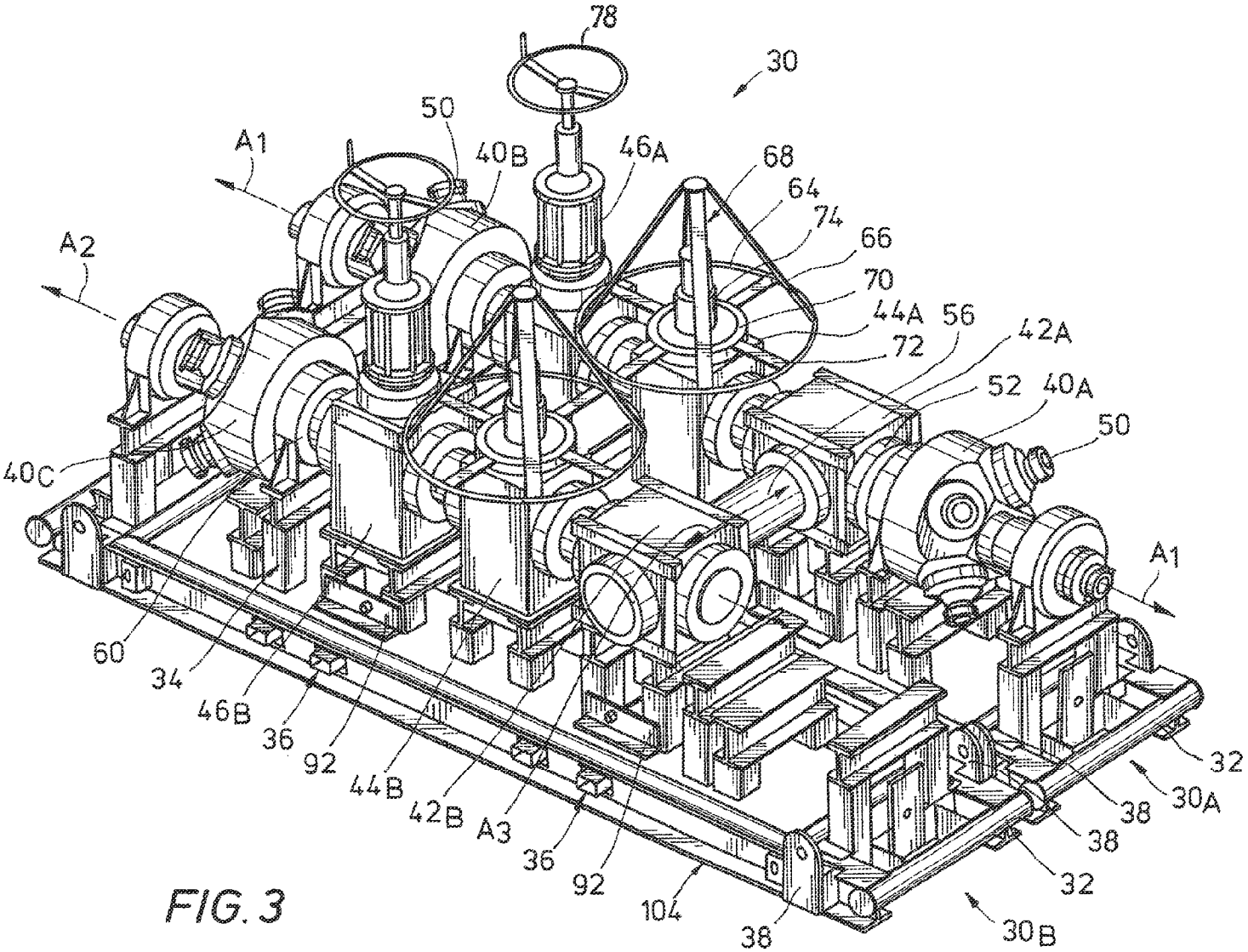
FIG. 3 is a perspective view of a fluid distribution system in accordance with an alternate embodiment of the present invention including two modules coupled and locked to one another.
Figure 4:
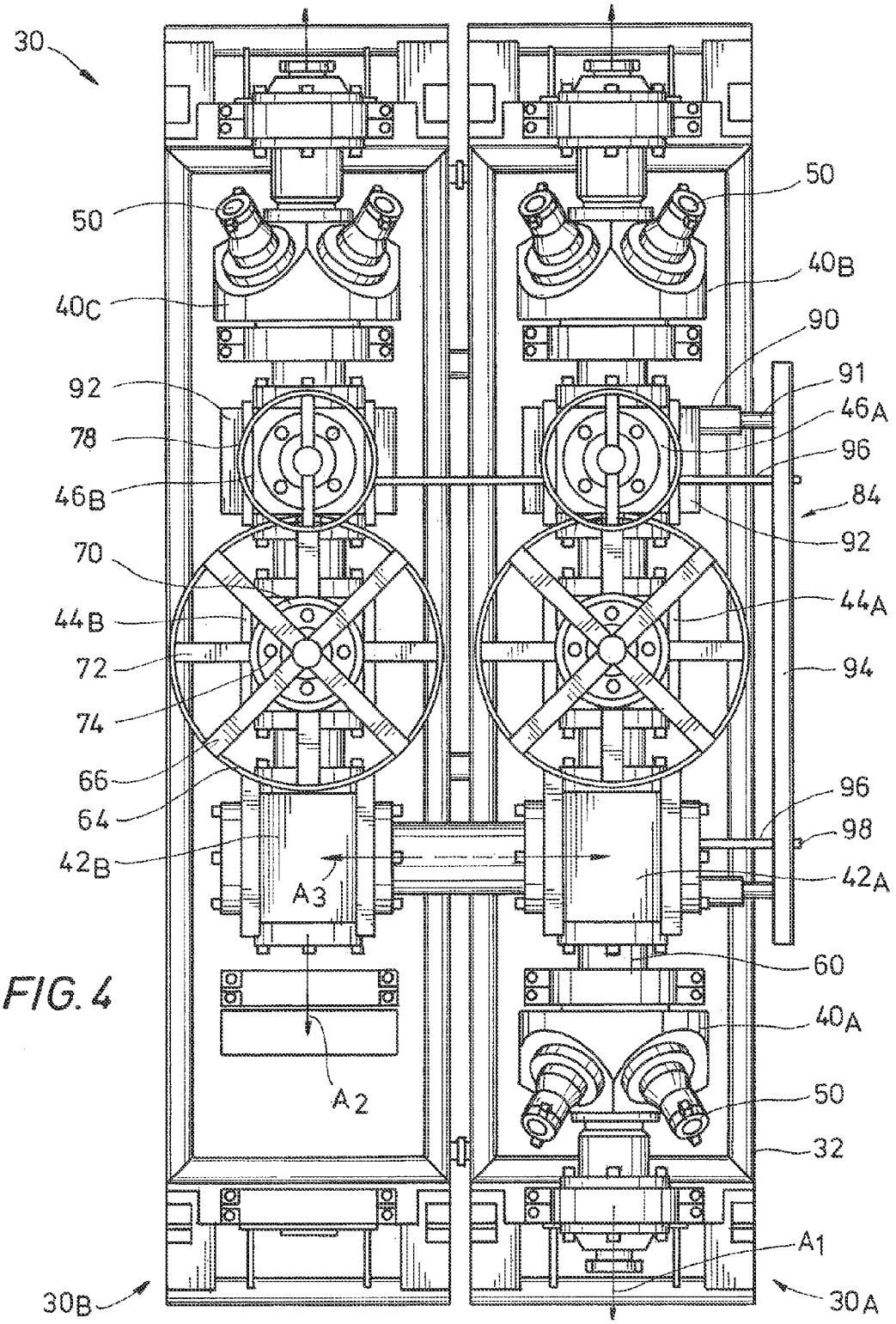
FIG. 4 is a top view of the fluid distribution system of FIG. 3.

Referring now to FIGS. 3 and 4, a fluid distribution system 30 includes first and second modules $\mathbf{30}_A$ and $\mathbf{30}_B$. The fluid distribution system 30 is configured to support concurrent operations at a well site with two (2) wellbores. The first and second modules $\mathbf{30}_A$, $\mathbf{30}_B$ selectively couple to additional modules (not shown) to support concurrent operations at an alternate well site having additional well bores. Each module $\mathbf{30}_A$, $\mathbf{30}_B$ includes a skid 32 including channels 36 defined therethrough. The skids 32 provide foundational support to the modules $\mathbf{30}_A$, $\mathbf{30}_B$, and the channels 36 provide access points for a forklift or other mechanism to lift or move the modules $\mathbf{30}_A$, $\mathbf{30}_B$. Each module $\mathbf{30}_A$, $\mathbf{30}_B$ also includes frame 34 on the respective skid 32. The frames 34 support the various fluid components on each of the modules $\mathbf{30}_A$, $\mathbf{30}_B$. The skids 32 and the frames 34 of the two modules $\mathbf{30}_A$, $\mathbf{30}_B$ are substantially similar allowing for either module to $\mathbf{30}_A$, $\mathbf{30}_B$ to be constructed thereon.

In some embodiments, first and second modules $\mathbf{30}_A$ and $\mathbf{30}_B$ are coupled to one another by locking mechanisms including bolts or other fasteners (not shown). The bolts may extend through holes provided in adjacent lifting flanges 38. Lifting flanges 48 are often provided on lateral sides of each skid 32 to facilitate lifting the skid with a crane or similar mechanism. In other embodiments, the first and second modules $30_A$ and $30_B$ are selectively coupled to one another with locking mechanism 102, as described below with reference to FIG. 5, which includes a hand-actuated lever.

The fluid components supported on the first module $30_A$ include inlet goat-head $40_A$, a 4-way cross $42_A$, a manual valve $44_A$, a hydraulic valve $46_A$ and an outlet goat-head 408. A fluid flow path is defined through the first module $30_A$ between the inlet goat-head $40_A$ and the outlet goat-head $40_B$ along a generally straight axis $A_1$. The inlet and outlet goat-heads $40_A$, $40_B$ each include a plurality of quick-connect fluid connectors 50 supported thereon at an oblique angle to the axis $A_1$. The quick-connect fluid connectors 50 on the inlet goat-head $40_A$ selectively couple to fluid supply lines 20 (FIG. 2) to selectively provide fluid from a fluid source to the fluid distribution system 30. The 4-way cross $42_A$ includes flanged connectors 52 on four (sides) thereof. Two (2) of the flanged connectors 52 are aligned with the axis $A_1$ and permit the 4-way cross $42_A$ to fluidly couple the inlet goat-head $40_A$ to the manual valve $44_A$. The other two (2) flanged connectors 52 are substantially orthogonal to the axis $A_1$, and permit the 4-way cross $42_A$ to fluidly couple first module $30_A$ to additional modules, e.g., module $30_B$. The manual valve $44_A$ and the hydraulic valve $46_A$ are each operable to selectively permit or restrict fluid flow therethrough to selectively permit or restrict fluid flow through the flow path defined through the first module $30_A$. Although various types of valves are contemplated for use in the fluid distribution system 30, in this embodiment, the manual valve $44_A$ and the hydraulic valve $46_A$ are configured as gate valves having an internal gate (not shown) which is selectively movable with respect to an internal fluid flow path as will be appreciated by one skilled in the art. The quick-connect fluid connectors 50 on the outlet goat-head $40_B$ selectively couple to fluid distribution lines 22 (FIG. 2) to selectively fluidly couple the first module $30_A$ to a wellhead, e.g., wellhead $12_A$ (FIG. 2).

The fluid components supported on the second module $30_B$ include a 4-way cross $42_B$, a manual valve $44_B$, a hydraulic valve $46_B$ and an outlet goat-head $40_C$. The fluid components supported on the second module $30_B$ are substantially similar to the corresponding fluid components on the first module $30_A$, and define a fluid passage extending generally along a straight axis $A_2$. The second module $30_B$, however, does not include an inlet goat-head. The 4-way cross $42_B$ is fluidly coupled to the 4-way cross $42_A$ by a fluid conduit 56 defining a flow passage generally along an axis $A_3$. Thus, the 4-way cross $42_B$ serves as a fluid inlet to the second module $30_B$.

Various fluid couplings established on the first and second modules $30_A$, $30_B$ are strategically adjustable. For example, each of the goat-heads $40_A$, $40_B$ and $40_C$ are equipped with a threaded spool 60 that interfaces with the 4-way cross $42_A$ and/or the hydraulic valves $46_A$, $46_B$. The threaded spool 60 allows the goat heads $40_A$, $40_B$, $40_C$ to rotate about an axis, e.g., axis $A_1$, to allow the quick-connect fluid connectors 50 to be disposed at a convenient angle when secured to the respective adjacent component $42_A$, $46_A$, $46_B$. For example, fluid connectors 50 disposed at an approximate 45° angle with the vertical and horizontal, as depicted, provides adequate clearance from surrounding equipment for connection of the fluid supply lines 20 (FIG. 2) and fluid distribution lines 22 (FIG. 2). The fluid conduit 56 is likewise provided with a threaded spool (not shown) for interfacing with the 4-way crosses $42_A$ and $42_B$. The fluid conduit 56 is thus configured to accommodate variations in distances between modules $30_A$, $30_B$. and facilitates assembly of the fluid distribution system 30 at a well site.

The manual valves $44_A$, $44_B$ are each operatively coupled to a rotatable hand wheel 64 to open and close the fluid passages extending through the respective modules $30_A$, $30_B$. Each of the hand wheels 64 is supported by hangers 66 coupled to a valve stem 68 of the respective manual valve $44_A$, $44_B$. The valve stems 68 project from an upper surface of the manual valves $44_A$, $44_B$ and are selectively rotatable to move the internal gate (not shown) to operate the manual valves $44_A$, $44_B$. The hangers 66 extend radially outward from the valve stems 68 and provide a moment arm that facilitates rotation of the valve stems 68. The hangers 66 also extend downward from the valve stems 68 such that the hand wheels 64 are disposed at an appropriate elevation for manual operation by humans of average height. In this example embodiment, the hand wheels 64 are disposed at an elevation in the range of about 4 feet to about 6 feet from a lower surface of the skids 32. Thus, the hand wheels 64 are suspended at a suitable height for manual operation by an operator standing on the skids 32 or at ground level without the need for a ladder or a lift. The hand wheels 64 are readily accessible to rotate the valve stem 68, thereby moving the internal gate (not shown) to selectively permit or restrict fluid passage through the modules $30_A$ $30_B$. The hand wheels 64 are also coupled to an inner ring 70 by spokes 72. The inner ring 70 circumscribes an upward facing boss 74 of the manual valves $44_A$, $44_B$, and thus the inner ring 70 serves as a bushing to guide the rotation of the hand wheels 64.

The hydraulic valves $46_A$ and $46_B$ are also operatively coupled to hand wheels 78. The hand wheels 78 are provided for manual operation of the hydraulic valves $46_A$ and $46_B$, primarily in the event of a loss of hydraulic pressure or some other malfunction. Since frequent operation of the hand wheels 78 is not anticipated, the hand wheels 78 are provided at a substantially higher elevation than the hand wheels 64 associated with the manual valves $44_A$, $44_B$. In other embodiments (not shown) hand wheels are associated with the hydraulic valves $46_A$ and $46_B$ that are similarly arranged as the hand wheels 64.

Figure 5:
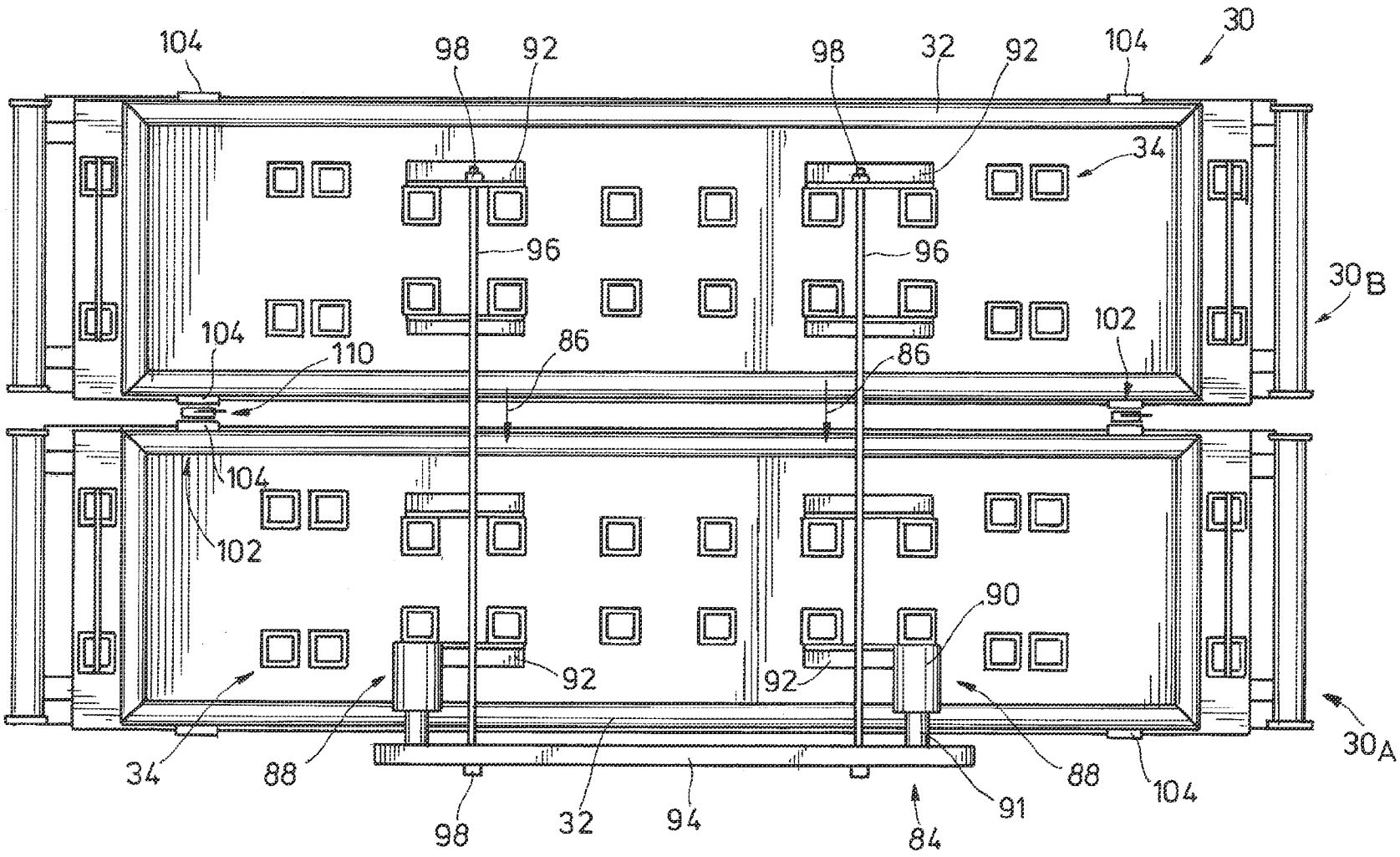
FIG. 5 is a schematic view of the fluid distribution system of FIGS. 3 and 4 illustrating a mechanism for approximating or drawing the two modules together.

As best illustrated in FIGS. 4 and 5, a conveyance mechanism 84 is provided to induce relative motion between the modules $30_A$, $30_B$ such that the modules $30_A$, $30_B$ are drawn together. For example, in this embodiment, the second module $30_B$ is drawn in the direction of arrows 86 (FIG. 5) toward the first module $30_A$. The conveyance mechanism 84 includes a pair of hydraulic jacks 88 on the first module $30_A$. The hydraulic jacks 88 may be commercially available products such as the 20-ton standard bottle jack, model number 76520, available from Norco® Professional Lifting Equipment, or from other manufacturers. The hydraulic jacks 88 each include a hydraulic cylinder 90 and a piston 91 selectively extendable therefrom. The hydraulic cylinders 90 are fixedly mounted to L-shaped angle brackets 92 on the frame 34 of the first module $30_A$. The pistons 91 are coupled to a beam 94, which, in this embodiment is constructed as a hollow rectangular channel (see FIG. 9). In other embodiments (not shown), the beam 94 is a solid elongated member extending between the pistons 91. The beam 94 is coupled to the second module $30_B$ by a pair of threaded rods 96 and a pair of L-shaped angle brackets 92 on the frame 34 of the second module $30_B$. The threaded rods 96 extend through the L-shaped angle brackets 92 and are secured thereto by nuts 98. Thus, when the pistons 91 are extended from the hydraulic cylinder 90, a tensile force is imparted to the threaded rods 96 through the beam 94, and the tensile force is transmitted to the angle brackets 92 on the frame 34 of the second module $30_B$ to draw the second module $30_B$ in the direction of arrows 86.

Figure 7:
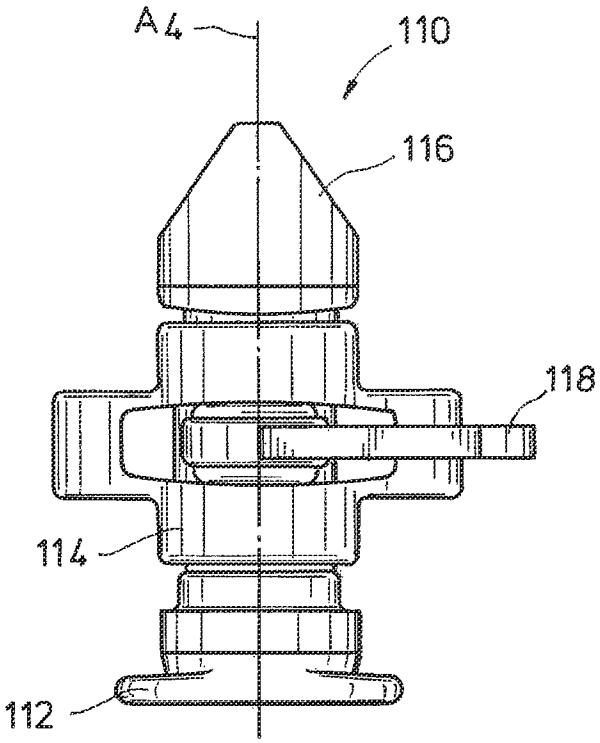
FIGS. 6 and 7 are depictions of components of a locking mechanism for locking the modules together.
Figure 6:
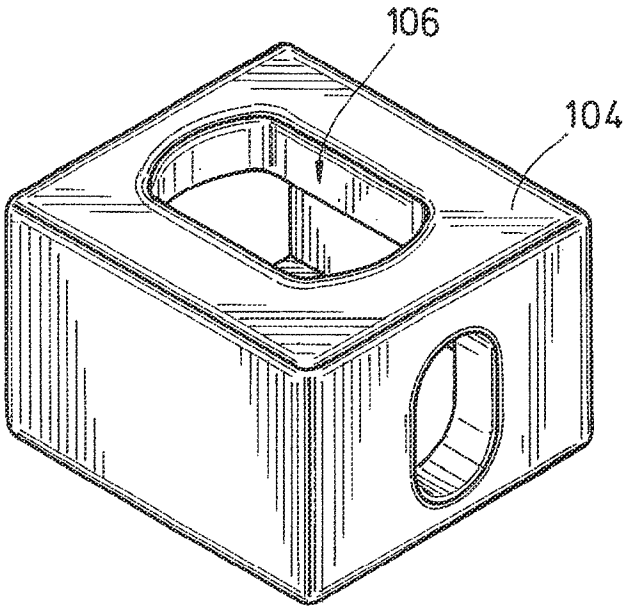

Referring now to FIGS. 5, 6 and 7, locking mechanisms 102 are provided to lock the modules $\mathbf{30}_A$, $\mathbf{30}_B$ together when the first and second modules 30A and 30B are approximated. The locking mechanisms 102 are established between the skids 32, and in this embodiment, each include a pair of corner blocks 104 fixedly coupled to opposing surfaces on the skids 32. The corner blocks 104 have a hollow interior and an elongated opening 106. A hand-actuated lever mechanism 110 is provided, which may be a commercially available product such as the Double Cone Two Position Twistloc, Item AE10000A-1GA, available from Tandemloc, Inc. or other manufacturers. The hand-actuated lever mechanism 110 includes a first cone 112 secured within the hollow interior of one of the corner blocks 104 such that a body 114 of lever mechanism 110 extends through the elongated opening 106. An elongated second cone 116 is operatively coupled to a hand actuated lever 118 to rotate about an axis $A_4$. When the modules $\mathbf{30}_A$ and $\mathbf{30}_B$ are approximated, the second cone 116 is received in the hollow interior of the opposing corner block 104 through the elongated opening 106. The elongated second cone 116 fits through the elongated opening 106 in a first orientation, and does not fit through the elongated opening 106 in a second orientation. Thus, the handle 118 is operable to rotate the elongated second cone 116 to the first orientation to permit separation of the first and second modules $\mathbf{30}_A$, $\mathbf{30}_B$ and operable to rotate the elongated second cone 116 to the second orientation to lock the modules $\mathbf{30}_A$, $\mathbf{30}_B$ together.

Figure 8:
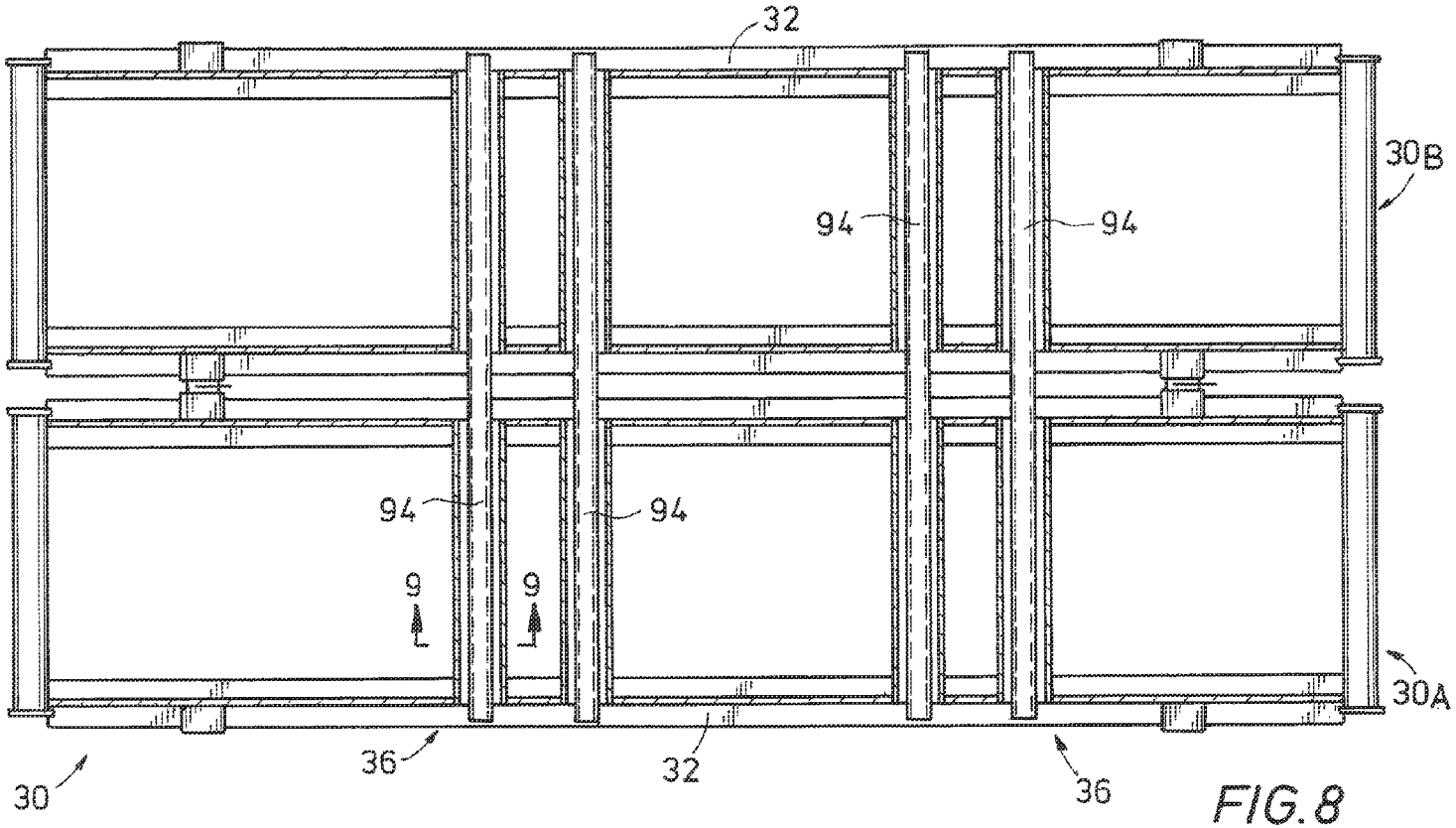
FIG. 8 is a schematic view of the fluid distribution system of FIGS. 3 and 4 with the two modules locked together and including a support brace for unitary transport.
Figure 9:
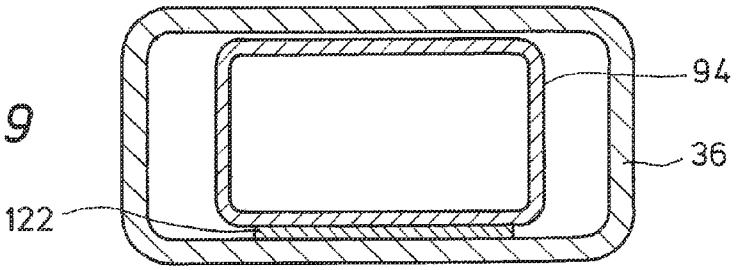
FIG. 9 is a cross-sectional view of the support brace of FIG. 8 taken along lines 9-9.

Referring now to FIGS. 8 and 9, with the first and second modules $\mathbf{30}_A$, $\mathbf{30}_B$ approximated and locked together, beams 94 are installed to brace and support the modules $\mathbf{30}_A$, $\mathbf{30}_B$ for unitary transport. Beams 94 are inserted into the channels 36 defined through the skids 32 of both of the modules $\mathbf{30}_A$, $\mathbf{30}_B$. Shims 122 are installed between the beams 94 and the channels such that an interference fit is established and the beams 94 are secured in the channels 36. The beams 94 installed in the channels 36 provide sufficient shear resistance to enable the first and second modules $\mathbf{30}_A$, $\mathbf{30}_B$ to be transported together. Since the beams 94 are configured as hollow channels, the beams 94 permit forks of a forklift (not shown) to enter the channels 36 to lift the modules $\mathbf{30}_A$, $\mathbf{30}_B$.

Figure 10:
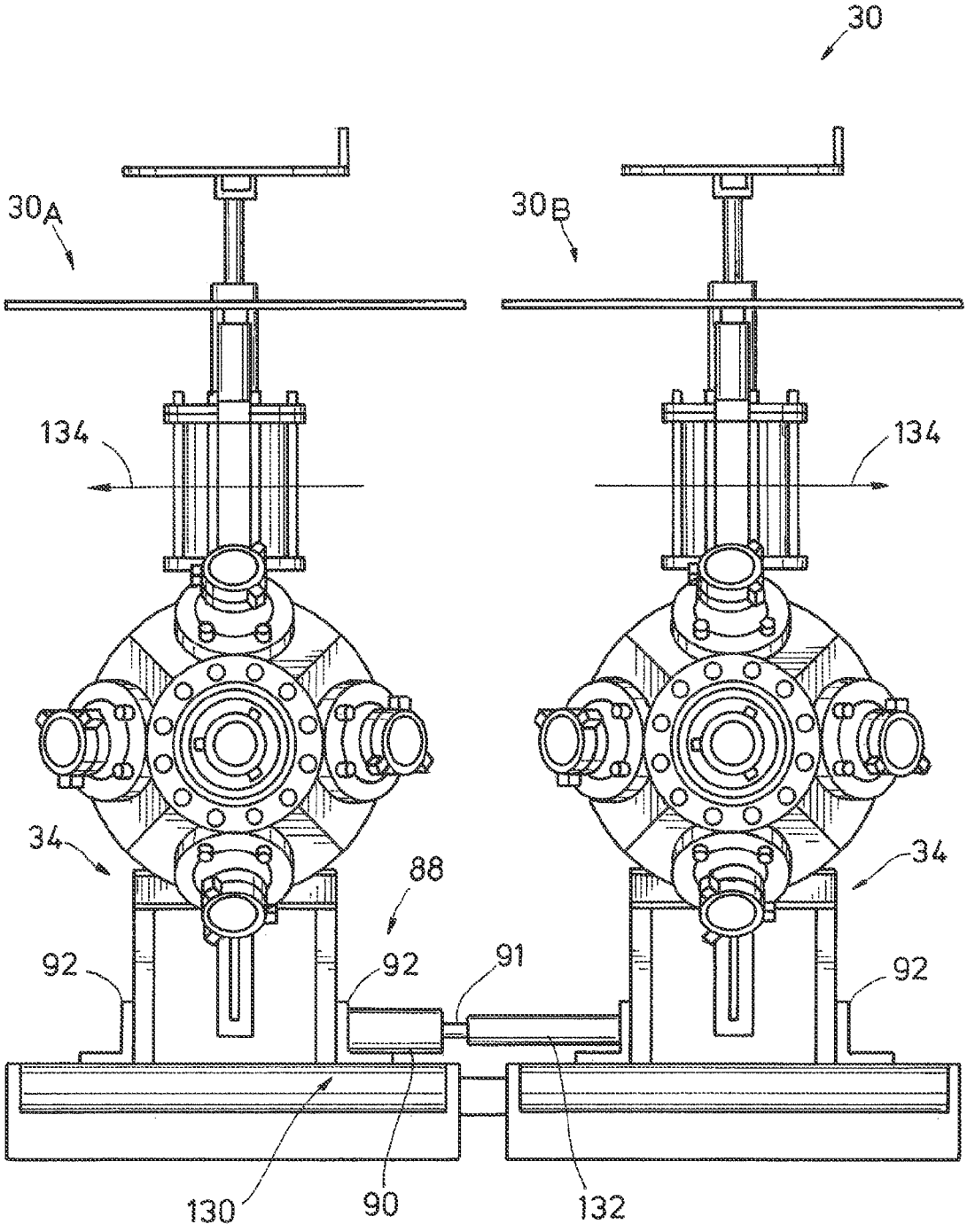
FIG. 10 is a schematic view of the fluid distribution system of FIGS. 3 and 4 illustrating a mechanism for separating two modules.

Referring now to FIG. 10, a conveyance mechanism 130 is provided to induce relative motion between the modules $\mathbf{30}_A$, $\mathbf{30}_B$ such that the modules $\mathbf{30}_A$, $\mathbf{30}_B$ are separated from one another. The conveyance mechanism 130 includes a pair of hydraulic jacks 88 (only one shown) with the hydraulic cylinders 90 fixedly coupled to one of the L-shaped angle brackets 92 on the frame 34 of one of the first and second modules $\mathbf{30}_A$, $\mathbf{30}_B$. The selectively extendable piston 91 is coupled to an extension member 132, which abuts an opposing L-shaped angle bracket 92 on the other of the first and second modules $\mathbf{30}_A$, $\mathbf{30}_B$. Thus, when the pistons 91 are extended from the hydraulic cylinder 90, a compressive force is imparted to the extension members 132, and the compressive force is transmitted to the angle brackets 92 to push the modules $\mathbf{30}_A$, $\mathbf{30}_B$ apart in the direction of arrows 134.

In one example embodiment of use, modules $\mathbf{30}_A$ and $\mathbf{30}_B$ (FIG. 3) are delivered to a well site individually, and coupled together at the well site to form fluid distribution system 30. Each of the modules $\mathbf{30}_A$ and $\mathbf{30}_B$ is placed in an approximate location by a fork lift (not shown) engaging the channels 36 (FIG. 3) on the skids 32. The fluid conduit 56 is then coupled to between the 4-way crosses $\mathbf{42}_A$ and $\mathbf{42}_B$. The conveyance mechanism 84 (FIG. 5) is installed and employed to draw the modules $\mathbf{30}_A$ and $\mathbf{30}_B$ together. Since the fluid conduit 56 is provided with threaded spools, adjustments are made to accommodate the change in distance between the 4-way crosses $\mathbf{42}_A$ and $\mathbf{42}_B$ (FIG. 3) as the conveyance mechanism 84 (FIG. 5) is operated. The modules $\mathbf{30}_A$ and $\mathbf{30}_B$ are drawn together until the second cones 116 (FIG. 7) of the hand actuated lever mechanisms 110 are disposed within the hollow interior of the opposing corner blocks 104 (FIG. 6). The hand actuated lever 118 is then rotated to lock the modules $\mathbf{30}_A$ and $\mathbf{30}_B$ together to form the fluid distribution system 30 (FIG. 3).

If it is desired to move the fluid distribution system 30 to another location on the well site, the beam 94 is removed from the conveyance mechanism 84 (FIG. 5) and installed in channels 36 of the skids 32 with additional beams 94 (FIG. 8). Shims 122 (FIG. 9) are installed to secure the beams 94 in the channels. A forklift engages the beams 94 to lift the modules $\mathbf{30}_A$ and $\mathbf{30}_B$ as a unitary fluid distribution system 30, and relocated.

The fluid distribution system 30 is then employed to support concurrent operations on two (2) wellbores. The inlet goathead $\mathbf{40}_A$ (FIG. 3) is connected to fluid supply lines 20 (FIG. 2) and the outlet goatheads $\mathbf{40}_B$ and $\mathbf{40}_C$ (FIG. 3) are connected to fluid distribution lines (FIG. 2). Concurrent fluid treatment cycles and down-hole operations are then performed as described above with reference to FIGS. 1 and 2. Manual valve $\mathbf{44}_A$ and hydraulic valve $\mathbf{46}_A$ are opened while manual valve $\mathbf{44}_B$ and hydraulic valve $\mathbf{46}_B$ are closed. In this configuration, a fluid treatment cycle is carried out on a wellbore coupled to first module $\mathbf{30}_A$, and other concurrent downhole operations are carried out on a wellbore coupled to second module $\mathbf{30}_B$. Then, manual valve $\mathbf{44}_A$ and hydraulic valve $\mathbf{46}_A$ are closed, and manual valve $\mathbf{44}_B$ and hydraulic valve $\mathbf{46}_B$ are opened. In this configuration, a fluid treatment cycle is carried out the wellbore coupled to second module $\mathbf{30}_B$, and other concurrent downhole operations are carried out on the wellbore coupled to first module $\mathbf{30}_A$. This process of opening and closing valves $\mathbf{44}_A$, $\mathbf{46}_A$, $\mathbf{44}_B$, and $\mathbf{46}_B$ in an alternating pattern is continued until a sufficient number of fluid treatments, e.g., twenty (20) fluid treatments, is carried out on each of the wellbores coupled to the fluid distribution system 30.

When the concurrent operations are complete, the fluid distribution system 30 is disassembled by employing conveyance mechanism 130 (FIG. 10), or moved with the two modules $\mathbf{30}_A$, $\mathbf{30}_B$ together as necessary. When the fluid distribution system 30 is disassembled, the two modules $\mathbf{30}_A$, $\mathbf{30}_B$ are available for coupling to other similar fluid distribution systems (not shown) at alternate well sites for subsequent use, and when moved together, the fluid distribution system 30 readily couples to additional modules (not shown) for subsequent use.

Figure 11:
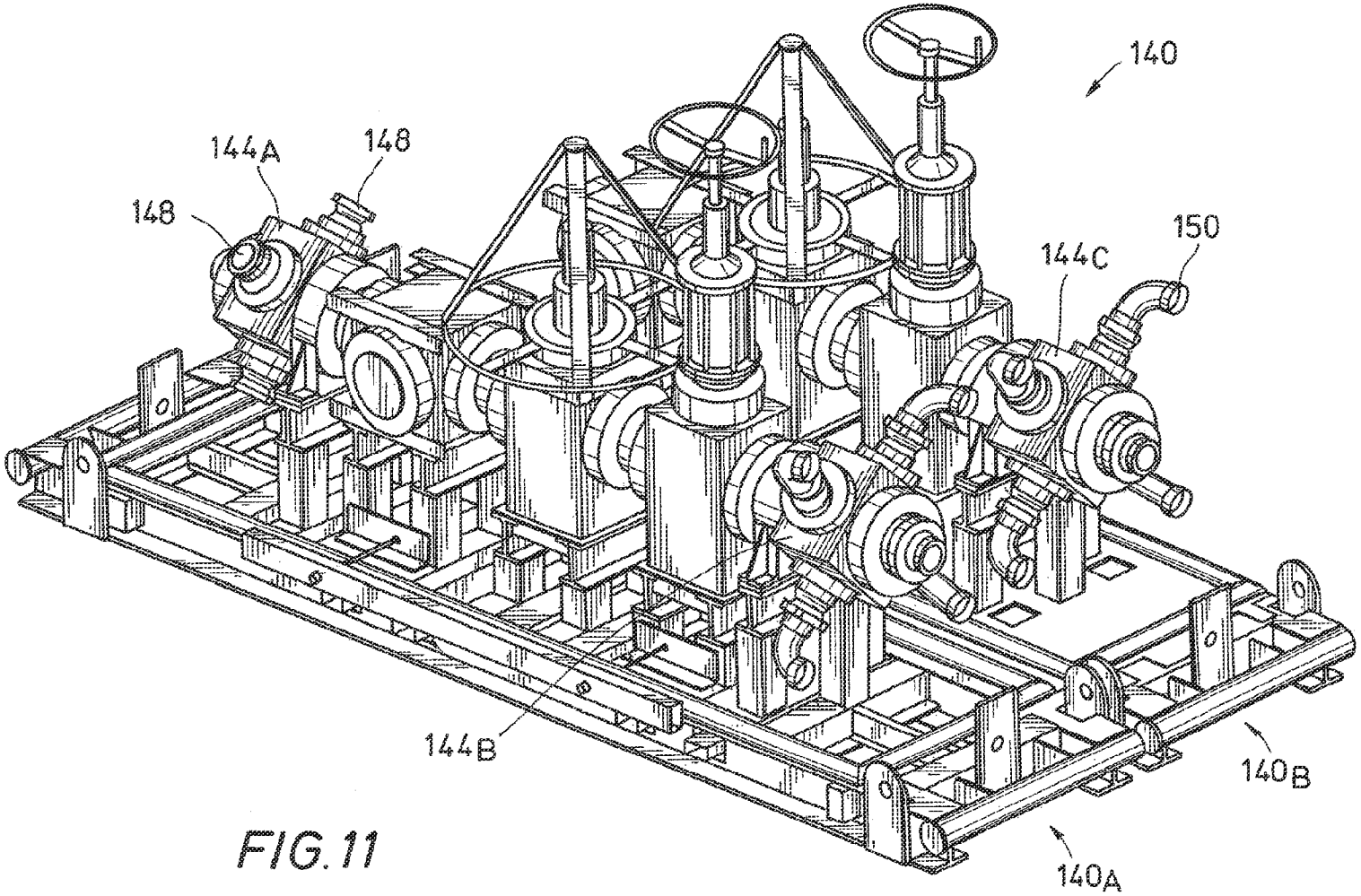
FIG. 11 is a perspective view of a fluid distribution system in accordance with an alternate embodiment of the present invention including alternate connectors for coupling to a fluid pumping system and a plurality of wellbores.

Referring now to FIG. 11, an alternate embodiment of a fluid distribution system 140 includes first and second modules $\mathbf{140}_A$ and $\mathbf{140}_B$. The modules $\mathbf{140}_A$ and $\mathbf{140}_B$ are substantially similar to the modules $\mathbf{30}_A$ and $\mathbf{30}_B$ (see FIG. 3) described above except that modules $\mathbf{140}_A$ and $\mathbf{140}_B$ support 6-way crosses $\mathbf{144}_A$, $\mathbf{144}_B$ and $\mathbf{144}_C$ thereon rather than goat-heads $\mathbf{40}_A$, $\mathbf{40}_B$ and $\mathbf{40}_C$. An inlet 6-way cross $\mathbf{144}_A$ provided on the first module $\mathbf{140}_A$ includes four (4) flanged connectors 148 for connection to fluid supply lines 20 (FIG. 2) such that the 6-way cross $\mathbf{144}_A$ serves as a fluid input to the fluid distribution system 140. Outlet 6-way crosses $\mathbf{144}_B$ and $\mathbf{144}_C$ are provided with 90° elbows 150 coupled to the flanged connectors 144 to facilitate connection of fluid distribution lines 22 (FIG. 2) thereto. In other embodiments (not shown) 90° elbows 150 are also provided on the inlet 6-way cross 144A.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A fluid distribution system for use in a fluid system for providing fluid treatments to a plurality of wellbores, the fluid distribution system comprising:

a first module comprising a first fluid inlet, a first fluid outlet and at least one first valve coupled between the first fluid inlet and the first fluid outlet, the first fluid outlet and the at least one first valve arranged along a generally straight first axis;

a second module comprising a second fluid inlet, a second fluid outlet and at least one second valve coupled between the second inlet and the second outlet, the second fluid inlet, the second fluid outlet and the at least one second valve arranged along a generally straight second axis;

a first fluid conduit extending between the first module and the second module along a third axis that is generally orthogonal to the first axis and the second axis, the first fluid conduit fluidly coupling the second fluid inlet to the first fluid module; and wherein a fluid flow path between the first fluid inlet and any valve of the first module and the second module includes a change in direction located between an entrance of the first fluid inlet and the valve so that fluid entering the first fluid inlet passes through the change in direction before reaching any valve.

2. The fluid distribution system of claim 1, further comprising a locking mechanism operable to selectively lock the first module to the second module to prevent relative motion therebetween, wherein the locking mechanism comprises a hand-actuated lever mechanism disposed between the first skid and the second skid.

3. The fluid distribution system of claim 1, wherein the first skid comprises a first pair of channels defined therethrough and the second skid comprises a second pair of channels defined therethrough, and wherein the second pair of channels is aligned with the first pair of channels such that a pair of beams is receivable within each channel of the first pair of channels and extendable through each channel of the second pair of channels to provide shear resistance to the first and second modules.

4. The fluid distribution system of claim 3, wherein the pair of beams are configured as hollow channels such that the channels are operable to receive forks of a forklift when the pair of beams is received within the first pair of channels and the second pair of channels.

5. The fluid distribution system of claim 1, wherein the at least one first valve comprises a manual valve and a hydraulic valve coupled to one another in series between the first fluid inlet and the first fluid outlet.

6. The fluid distribution system of claim 5, wherein the manual valve comprises a valve stem projecting from an upper surface thereof and operable to open and close the manual valve, the valve stem coupled to a rotatable hand wheel by hangers extending downwardly from the valve stem.

7. The fluid distribution system if claim 6, wherein the hangers extend radially outward and axially downward from the valve stem to support the hand wheel at an elevation in the range of about 4 feet to about 6 feet from a lower surface of the first skid.

8. The fluid distribution system of claim 1, wherein a cross serves as the fluid inlet of the second module, the cross having a first opening coupled to the first fluid conduit and a second opening opposite the first opening operable to receive a second fluid conduit.

9. The fluid distribution system of claim 8, wherein the second opening is coupled to the second fluid conduit, and wherein the second fluid conduit is coupled to a third module comprising a third fluid inlet, a third fluid outlet and at least one third valve coupled between the third inlet and the third outlet.

10. The fluid distribution system of claim 1, wherein the first fluid outlet comprises a goat head including a plurality of quick-connect fluid connectors supported thereon at oblique angles with respect to the first axis.

11. The fluid distribution system of claim 10, wherein the goat head is adjustably mounted on the first module on a threaded spool to permit the goat head to selectively rotate about the first axis to allow the quick-connect fluid connectors to be secured at adjustable angles with respect to the first axis.

12. The fluid distribution system of claim 1, further comprising a conveyance mechanism coupled to at least one of the module and the second module, the conveyance mechanism operable to selectively induce relative motion between the first module and the second module along the third axis.

13. The fluid distribution system of claim 12, wherein the conveyance mechanism comprises a hydraulic jack including a hydraulic cylinder fixedly coupled to a first one of the first skid and the second skid, and a piston fixedly coupled to a second one of the first skid and the second skid, and wherein the piston is selectively extendable from the hydraulic cylinder to approximate the first skid and the second skid.

14. The fluid distribution system of claim 1, wherein the first fluid conduit accommodates variations in location between the first module and the second module.

15. The fluid distribution system of claim 1, further comprising a locking mechanism operable to selectively lock the first module to the second module to prevent relative motion therebetween, wherein the locking mechanism includes threaded fasteners.

16. A method for assembling a fluid distribution system for providing fluid treatments to a plurality of wellbores, the method comprising:

(a) providing a first module including a first fluid inlet, a first fluid outlet and a first valve mounted to a first skid, the first valve coupled between the first fluid inlet and the first fluid outlet;

(b) providing a second module including a second fluid inlet, a second fluid outlet, and a second valve mounted to a second skid, the second valve coupled between the second fluid inlet and the second fluid outlet;

(c) approximating the first skid and the second skid;

(d) locking the first skid to the second skid to prevent relative motion therebetween; and (e) coupling a fluid conduit between the second fluid inlet and the first module between the first fluid inlet and the first valve such that a fluid flow path between an entrance of the first fluid inlet and any valve of the first module and the second module includes a change in direction located between the first fluid inlet and the valve so that fluid entering the first fluid inlet passes through the change in direction before reaching any valve.

* * * * *